United States Patent [19]

Flemings et al.

[11] 4,345,637

[45] Aug. 24, 1982

[54] METHOD FOR FORMING HIGH FRACTION SOLID COMPOSITIONS BY DIE CASTING

[75] Inventors: Merton C. Flemings, Cambridge, Mass.; Rodney G. Riek, Maryland Heights; Kenneth P. Young, Ballwin, both of Mo.

[73] Assignee: Massachusetts Institute of Technology, Cambridge, Mass.

[21] Appl. No.: 94,636

[22] Filed: Nov. 15, 1979

Related U.S. Application Data

[63] Continuation-in-part of Ser. No. 853,795, Nov. 21, 1977, abandoned.

[51] Int. Cl.[3] ..... B22D 17/00

[52] U.S. Cl. ..... 164/113; 164/348; 164/122; 164/900; 164/121

[58] Field of Search ..... 164/71, 72, 113, 303, 164/312, 314, 348, 121, 900

[56] References Cited

U.S. PATENT DOCUMENTS 2,923,041 2/1960 Ryznar ..... 164/72

FOREIGN PATENT DOCUMENTS 1543206 3/1979 United Kingdom ..... 164/71

OTHER PUBLICATIONS

Rheocasting Processes; Flemings et al.; AFS International Cast Metals Journal; Sep. 1976, pp. 11–22.

Automation Comes to Die Casting; Radke and Smith, Tool and Manufacturing Engineer; vol. 53, No. 3, Sep. 1964.

*Primary Examiner*—Gus T. Hampilos

*Assistant Examiner*—K. Y. Lin

*Attorney, Agent, or Firm*—Arthur A. Smith, Jr.; Paul J. Cook

[57] ABSTRACT

Die castings are made from metal compositions that are fully liquid or as a preferred embodiment contain between about 10 and 85 weight percent degenerate dendrites. The composition is injected into the cavity of a die at a mean die temperature which is as near to ambient temperature as possible and usually less than about 400° F. The die is formed of a material having a thermal diffusivity of at least about 0.5 $cm^2$/sec. The castings are ejected and the die surface is sprayed with a liquid to bring the die surface temperature back to the mean die temperature or below in the shortest possible time. The time between injection and ejection is less than about 1 minute and the time between ejection and spraying is less than about 30 seconds.

10 Claims, No Drawings

METHOD FOR FORMING HIGH FRACTION SOLID COMPOSITIONS BY DIE CASTING

BACKGROUND OF THE INVENTION

The invention described herein was made in the course of work performed under Contract No. DAAG-46-73-C-0110 with the Department of the Army.

REFERENCE TO RELATED APPLICATION

This application is a continuation-in-part of application Ser. No. 853,795, filed Nov. 21, 1977, now abandoned.

This invention relates to a process for casting metal compositions.

Prior to the present invention, metal compositions have been cast in dies formed of a material having high thermal conductivity such as copper wherein the die is maintained at an elevated temperature of about 300°-400° F. or more. A survey of materials used to form dies is presented in Paper No. 803 presented at the fourth national die casting exposition and congress, Nov. 14-17, 1966 and available from The Society of Die Casting Engineer, Inc., 14530 West 8 Mile Road, Detroit, Mich., 48237. When the dies are maintained at these high temperatures during casting, the residence time for the metal in the die is unduly long to permit the metal to become sufficiently solidified so that it retains its shape when removed from the die. In addition, when the die is maintained at these high temperatures, the life is reduced seriously because of thermal degradation and undesirable oxidation or nitriding of the die material.

It would be highly desirable to provide a process for casting metals which avoids the necessity of heating the dies. In addition, it would be desirable to provide a die casting process which can be conducted at pressures below that needed in present die casting processes in order to reduce process energy requirements. Furthermore, it would be desirable to provide a die casting process wherein the metal composition being cast fills the die cavity fully more consistently than in present processes for casting liquid metal compositions.

SUMMARY OF THE INVENTION

In accordance with this invention, a metal composition that is fully liquid or as a preferred embodiment that contains at least about 10 weight percent degenerate dendrites homogeneously dispersed therein are cast in die having a thermal diffusivity of at least about 0.5 $cm^2/sec$. The mean temperature of the die is reduced to as near to ambient as possible and usually less than about 400° F. prior to injecting the metal composition into the die mold and the die is cooled during casting in order to remove sensible and latent heat from the metal composition quickly and in order to reduce thermal degradation of the die in order to extend die life. The time between injection and ejection is less than about 1 minute and the time between spraying and ejection is less than about 30 seconds in order to minimize heat penetration into the die walls. It has been found that by casting metal compositions in accordance with this invention, needed residence time in the dies is greatly reduced, the die is subjected to a minimum of thermal fatigue, needed injection pressures are greatly reduced when casting solids-containing metal compositions and the die cavities are filled fully more consistently than when casting liquid metal compositions when casting solids-containing metal compositions.

DESCRIPTION OF SPECIFIC EMBODIMENTS

The metal compositions cast in accordance with this invention are liquid or preferably contain at least 10 weight percent and up to 85 weight percent degenerate dendrites homogeneously dispersed in the compositions preferably between about 50 and 85 weight percent degenerate dendrites. These compositions and methods for their preparation are disclosed in U.S. Pat. Nos. 3,948,650, issued Apr. 6, 1976, 3,954,455, issued May 4, 1976, 3,951,651, issued Apr. 20, 1976, 3,936,289, issued Feb. 3, 1976 and U.S. application Ser. No. 725,903, filed Sept. 22, 1976, Flemings et al, all of which are incorporated herein by reference.

The metal compositions useful in this invention can be either solid or partially solid and partially liquid and comprise primary solid discrete particles and a secondary phase. The secondary phase is solid when the metal composition is solid and is liquid when the metal composition is partially solid and partially liquid. These compositions can be formed from a wide variety of metals or metal alloy compositions. The primary particles comprise small degenerate dendrites or nodules which are generally spheroidal in shape and are formed as a result of agitating the melt when the secondary phase is liquid. The primary solid particles are made up of a single phase or plurality of phases having an average composition different from the average composition of the surrounding matrix, which matrix can itself comprise primary and second phases upon further solidifications.

By the term "primary solid" as used herein is meant the phase or phases solidified to form discrete degenerate dendrite particles as the temperature of the melt is reduced below the liquidus temperature of the alloy into the liquid-solid temperature range prior to casting the liquid-solid slurry formed. By the term "secondary solid" as used herein is meant the phase or phases that solidify from the liquid existing in the slurry at a lower temperature than that at which the primary solid particles are formed after agitation ceases. The primary solids obtained in the composition of this invention differ from normal dendrite structures in that they comprise discrete particles suspended in the remaining liquid matrix. Normally solidified alloys, in absence of agitation, have branched dendrites separated from each other in the early stages of solidification, i.e. up to 15 to 20 weight percent solid, and develop into an interconnected network as the temperature is reduced and the weight fraction solid increases. The structure of the composition used in this invention on the other hand prevents formation of the interconnected network by maintaining the discrete primary particles separated from each other by the liquid matrix even up to solid fractions of about 85 weight percent or above. The primary solids are degenerate dendrites in that they are characterized by having smoother surfaces and less branched structures which approach a spherical configuration than normal dendrites and may have a quasi-dendritic structure on their surfaces but not to such an extent that interconnection of the particles is effected to form a network dendritic structure. The primary particles may or may not contain liquid entrapped within the particles during particle solidification depending upon severity of agitation and the period of time the particles are retained in the liquid-solid range. However, the weight fraction of entrapped liquid is less than that existing in a normally solidified alloy at the same temperature employed by present processes other than that disclosed in the above patents and patent application to obtain the same weight fraction solid.

The secondary solid which is formed during solidification from the liquid matrix subsequent to forming the primary solid contains one or more phases of the type which would be obtained during solidification of a liquid alloy of identical composition by presently employed casting processes. That is, the secondary solid can comprise dendrites, single or multiphase compounds, solid solutions or mixtures of dendrites, compounds and/or solid solutions.

The size of the primary particles depends upon the alloy or metal compositions employed, the temperature of the solid-liquid mixture and the degree of agitation employed with larger particles being formed at lower temperature and when using less severe agitation. Thus, the size of the primary particles can range from about 1 to about 10,000 microns. It is preferred that the composition contain as high a weight percent primary particles as possible, consistent with a viscosity which promotes ease of casting or forming while minimizing heat damage to the forming or casting apparatus.

The compositions used in this invention can be formed from any metal alloy system or pure metal regardless of its chemical composition. Even though pure metals and eutectics melt at a single temperature, they can be employed to form the composition used in this invention since they can exist in liquid-solid equilibrium at the melting point by controlling the net heat input or output to the melt so that, at the melting point, the pure metal or eutectic contains sufficient heat to fuse only a portion of the metal or eutectic liquid. This occurs since complete removal of heat of fusion in a slurry employed in the casting process of this invention cannot be obtained instantaneously due to the size of the casting normally used and the desired composition is obtained by equating the thermal energy supplied, for example by vigorous agitation and that removed by a cooler surrounding environment. Representative suitable alloys include magnesium alloys, zinc alloys, aluminum alloys, copper alloys, iron alloys, nickel alloys, cobalt alloys and lead alloys such as lead-tin alloys, zinc-aluminum alloys, zinc-copper alloys, magnesium-aluminum alloys, magnesium-aluminum-zinc alloys, magnesium-zinc alloys, aluminum-copper alloys, aluminum-silicon alloys, aluminum-copper-zinc-magnesium alloys, copper-tin bronzes, brass, aluminum bronzes, carbon steels, cast irons, tool steels, stainless steels, super-alloys such as nickel-iron alloys, nickel-iron-cobalt-chromium alloys and cobalt-chromium alloys or pure metals such as iron, copper or aluminum.

The liquid-solid mixture can, when the desired ratio of liquid-solid has been reached, be cast directly or can be cooled rapidly to form a solid for easy storage. Later, the solid can be raised to the temperature of the liquid-solid mixture, for the particular ratio of interest, and then cast. Metals or alloys prepared according to the procedure just outlined possess thixotropic properties. It can thus, be fed into the die casting machine in apparently solid form. However, shear resulting when this apparently solid metal or alloy is forced into a die cavity causes the semi-solid to transform to a material whose properties are more nearly that of a liquid. A metal or alloy having thixotropic properties also can be obtained by cooling the liquid-solid mixture to a temperature higher than that at which all of the liquid solidifies and the composition obtained can be formed to shape. This technique can be effected even with metal compositions containing up to about 85 weight percent degenerate dendrites.

In one aspect of the present invention, a metal-metal or metal-nonmetal composite composition can be cast which comprises a metal or metal alloy matrix containing third phase solid particles homogeneously distributed within the matrix and having a composition different from the metal or metal alloy. The third phase particles are incorporated into the slurry compositions by adding them to the slurry and agitating the resulting composition until the third phase particles are dispersed homogeneously. The particles added as third phase particles to the slurry have a surface composition that may or may not be wet by the liquid portion of the metal to which it is added to effect its retention homogeneously within the metal matrix. As employed herein, a composition that is wet refers to compositions which, when added to a metal or metal alloy at or slightly above the liquidus temperature of the metal or metal alloy and mixed therein, as by agitation with rotating blades, for a suitable period of time to effect intimate contact therewith, e.g. about 30 minutes, are retained in measurable concentrations within the liquid after agitation thereof has ceased and the resultant composition is allowed to return to a quiescent state when the metal or metal alloy is at or slightly above the liquidus temperature. When third phase particles are incorporated into a metal or metal alloy which wets the particles at the liquidus temperature of the metal or metal alloys, the particles are retained therein in concentrations from a measurable concentration of slightly above 0 percent by weight, and generally up to about 5 percent by weight. Representative examples of wetting comprise a system including nickel-coated graphite in aluminum alloys, as disclosed by U.S. Pat. No. 3,600,163 and tungsten carbide in aluminum, magnesium or zinc as disclosed by U.S. Pat. No. 3,583,471. These patents are incorporated herein by reference. In some cases, the concentration of third phase particles can be up to about 30 percent by weight. Representative examples of solid particles that are not wet by certain metal compositions include graphite, metal carbide, sand, glass, ceramics, metal oxides such as thorium oxide, pure metals and alloys, etc.

In the present invention, the third phase particles can be added to the slurry composition in concentrations up to about 30 weight percent. The metal or metal alloy can be solid or partially solid and has up to about 85 weight percent of a structure comprising degererate dendritic or nodular primary discrete solid particles suspended in a secondary phase having a lower melting point than the primary particles which secondary phase can be solid or liquid. These compositions are formed by heating a metallic composition to a temperature at which most or all of the metallic composition is in a liquid state, and vigorously agitating the composition to convert any solid particles therein to degenerate dendrites or nodules having a generally spheroidal shape. Solid particles comprising the third phase of the composition are added to the liquid-solid metallic composition after all or a portion of the primary solids have been formed and the third phase particles are dispersed within the metal composition such as by agitation. After the third phase particles have been dispersed in the metallic composition, the melt can be cast to a desired form, or can be cooled to form a composition which can be formed or cast subsequently by heating and shaping. In any case, the final formed composition contains primary solids.

The composition cast by this invention containing third phase particles can be formed from a wide variety of metals or alloys as set forth above in combination with nonmetallic or metallic third phase particles. The composition contains a secondary phase which can be either solid or liquid and a third phase which is solid, which third phase has a composition different from the primary solid particles and the secondary phase. The secondary phase is solid when the metal composition is solid and liquid when the metal composition is partially liquid.

The third phase of the compositions of this invention is formed by the solid particles which are added to the primary solid-secondary liquid phase slurry. For purposes of this invention, the composition of the particles forming the third phase can include any solid composition which normally is added to metal alloy compositions to change one or more physical characteristics of the metal alloy composition.

The weight percent of particles forming the third phase particles that can be added to a metal alloy can be varied widely. Higher weight percent of third phase particles can be added when the weight percentage of primary solids is relatively low. However, the primary particles should not be so small or widely distributed in the secondary phase as to present substantially no interaction with the third phase particles added. Generally, the primary particles should be present in the alloy in amounts of at least 65 weight percent and can vary up to about 85 weight percent.

During the particle addition step, the particles are added up to the capacity for the secondary phase to retain them and/or up to a weight fraction where the total weight fraction primary particles and third phase particles can be as high as about 95 weight percent. This capacity of retention of the third phase particles by the secondary phase is exceeded when the particles are observed to begin floating to the melt surface or sinking to the bottom of the melt. The formation of additional liquid subsequent to the third phase particles addition does not effect the removal of the previously added third phase particles since they have had time to become wet by the secondary liquid phase and/or to interact with the primary particles present therein so that they are retained in the metal composition. By operating in this manner, it is possible to attain up to about 30 weight percent third phase particle addition into the metal alloy. The preferred concentration of third phase particles depends upon the characteristics desired for the final metal composition and thus depends upon the metal alloy and particle compositions. The third phase particles are of a size which promotes their admixture to form homogeneous compositions and preferably of a size of between 1/100 and 10,000 microns.

When the desired composition has been formed, which consists of primary solid-secondary liquid-third phase particles, it can be cooled to form a solid for easy storage. Later the solid can be heated to a temperature wherein a primary solid-secondary liquid-third phase particle mixture is attained. Furthermore, a solid can be prepared which possesses thixotropic properties when reheated to the liquid-solid state. It can, thus, be fed into the die casting machine in apparently solid form. However, shearing resulting when this apparently solid composition is forced into the die cavity causes the composition to transform to a metal alloy whose properties are more nearly that of a liquid thereby permitting it to be shaped in conformance to the die cavity. A composition having thixotropic properties also can be obtained by cooling the primary solid-secondary liquid-third phase particle composition to a temperature higher than that at which all of the secondary liquid solidifies and the thixotropic composition obtained can be cast.

The above-described metal compositions are cast in accordance with this invention in a die formed of a metal having a high thermal diffusivity of at least about 0.5 $cm^2$/sec. The temperature of the die is as near to ambient temperature as possible and usually less than about 400° F. prior to introducing the metal composition therein. Die cooling is effected by spraying the die cavity surface with a liquid immediately after casting to avoid excessive penetration of heat into the die wall. Spraying may or may not be followed by drying with a gas under pressure. The liquid may contain a die lubricant such as acetylene black or the like in a liquid such as water or alcohol. In conjunction with the above process, conventional means of die cooling may also be used. In order to minimize heat penetration into the die walls while effecting metal solidification, the time between injection and ejection is less than about 1 minute, preferably less than about 30 seconds and the time between ejection and spraying is less than about 30 second, preferably less than about 10 seconds.

Representative suitable die materials include copper, chrome copper alloy containing about 1 weight percent chromium, copper-zirconium-chromium alloys containing about 0.5 weight percent chromium and zirconium, molybdenum-titatium-zinc alloy (TZM) or the like. The above die materials are only representative of the die materials useful herein. All that is necessary is that the die material have a thermal diffusivity of at least about 0.5 $cm^2$/sec and be sufficiently mechanically stable to withstand normal maximum die surface temperatures.

The process of this invention has a variety of significant advantages over prior art die casting processes. It has been found that the time required for making a die casting in accordance with this invention is less than one-half the time required with prior art processes including prior art processes utilizing high thermal diffusivity dies but at elevated temperatures. In many cases, the casting time required with the process of this invention is significantly less than one-half the time required for prior art die casting processes. Thus, the dies of this invention are subjected to far less thermal and heat effects which cause die degradation as compared to prior art processes. In addition, this invention provides significantly higher rates of production of die castings as compared to prior art processes. In addition, it has been found that the metal compositions utilized in this invention fill the dies fully more consistently than liquid metal compositions which results in higher production of satisfactory castings as compared with processes utilizing liquid metal compositions. This result is somewhat surprising since the metal compositions utilized in this invention are more viscous than liquid compositions and therefore would appear to present possible problems in filling the die. A further advantage of this invention is that it has been found that needed injection pressures to fill the die with the metal compositions utilized herein are significantly less than the minimum injection pressures found necessary with prior art processes. It has been found that the minimum injection pressures required herein are in the order of about 6,500 psi as compared to prior art processes which require minimum injection pressures in the order of about 10,000–12,000 psi. This significantly reduces the energy requirements of the process of this invention. However, it is to be understood that the process of this invention is not limited to the use of these low injection pressures but that the higher injection pressures could be employed to obtain satisfactory castings if desired.

EXAMPLE I

Dies were formed of pure non-deoxidized copper having a rifle hammer shaped cavity measuring about $2\times\frac{1}{2}\times\frac{1}{4}$ inches. The metal composition cast by the method below comprised AISI 440 C stainless steel containing about 55 weight percent degenerate dendrites. The solid metal composition was heated to about 1420° C. so that it was rendered thixotropic. Prior to injecting the metal composition into the die cavity, the cavity was sprayed for about 30 seconds with water containing about 10 weight percent acetylene black lubricant to reduce the die temperature to about 50° C. The die then was dried with pressurized air. The die inserts were held mechanically in place within standard H-13 die holders. The metal composition then was injected into the die cavity at a pressure of about 6,500 psi and was allowed to remain in the die for about 0.2–0.3 seconds. The casting then was ejected and the cavity immediately thereafter sprayed and dried to reduce its temperature to about 50° C.

The above procedure was repeated in the same die for 200 castings with no sign of deterioration. The residence time of 0.2 to 0.3 seconds compares with a required residence time of 1 second with tool steel dies of the same internal configuration and when casting the same metal composition.

We claim:

1. The method of casting a metal composition which is at least partially liquid and when partially liquid contains between about 1 weight percent and about 85 weight percent degenerate dendrites homogeneously dispersed within a liquid phase of said metal composition which comprises injecting under pressure said metal composition into a die formed of a material having a thermal diffusivity of at least about 0.5 $cm^2/sec$, solidifying said material in said die, ejecting the solidified material from said die and maintaining said die at an original mean die temperature prior to said injecting step of not more than 400° F. by spraying the cavity surface of the die directly with a liquid coolant, the temperature of the liquid being sufficiently low so as to reduce the mean die temperature back to a mean die temperature of not more than its original mean die temperature and to not more than about 400° F. and to minimize penetration of heat from said metal composition into the wall of the die so that the heat extracted from said composition during casting is removed from the mold during the subsequent spraying step and repeating said injecting, solidifying, ejecting and spraying steps, the time between said injecting step and said ejecting step being less than about 1 minute and the time between said ejection step and said spraying step being less than about 30 seconds thereby to minimize penetration of heat from said metal composition into the wall of the die so that the heat extracted from said composition during casting is removed from the mold during the subsequent spraying step.

2. The process of claim 1 wherein said metal composition contains third phase particles.

3. The process of claim 1 wherein the metal composition contains between about 50 weight percent degenerate dendrites and about 85 weight percent degenerate dendrites.

4. The process of claim 1 wherein the metal composition contains between about 10 weight percent degenerate dendrites and about 85 weight percent degenerate dendrites.

5. The process of claim 1 wherein said die material comprises copper or a copper alloy.

6. The process of claim 2 wherein said die material comprises copper or a copper alloy.

7. The process of claim 3 wherein said die material comprises copper or a copper alloy.

8. The process of claim 1 wherein said liquid coolant contains a die lubricant.

9. The process of claim 1 wherein said liquid coolant comprises water.

10. The process of claim 2 wherein said liquid coolant comprises water.

* * * * *